US011807027B2

(12) United States Patent
Bauer et al.

(10) Patent No.: US 11,807,027 B2
(45) Date of Patent: Nov. 7, 2023

(54) LITHO STRIP HAVING FLAT TOPOGRAPHY AND PRINTING PLATE PRODUCED THEREFROM

(71) Applicants: Oliver Bauer, Bonn (DE); Gernot Nitzsche, Meckenheim (DE); Volkan Barisik, Wuppertal (DE); Vera Bartosinski, Duesseldorf (DE); Jasmin Dahmen, Grevenbroich (DE); Klaus Weichbrodt, Grevenbroich (DE); Jan Hendrik Holtz, Krefeld (DE)

(72) Inventors: Oliver Bauer, Bonn (DE); Gernot Nitzsche, Meckenheim (DE); Volkan Barisik, Wuppertal (DE); Vera Bartosinski, Duesseldorf (DE); Jasmin Dahmen, Grevenbroich (DE); Klaus Weichbrodt, Grevenbroich (DE); Jan Hendrik Holtz, Krefeld (DE)

(73) Assignee: Speira GmbH, Grevenbroich (DE)

( * ) Notice: Subject to any disclaimer, the term of this patent is extended or adjusted under 35 U.S.C. 154(b) by 0 days.

(21) Appl. No.: 17/944,667

(22) Filed: Sep. 14, 2022

(65) Prior Publication Data

US 2023/0086926 A1 Mar. 23, 2023

Related U.S. Application Data

(63) Continuation of application No. PCT/EP2021/057948, filed on Mar. 26, 2021.

(30) Foreign Application Priority Data

Mar. 26, 2020 (EP) ..... 20165738

(51) Int. Cl.

| | |
|---|---|
| ***B41N 1/08*** | (2006.01) |
| ***C22C 21/00*** | (2006.01) |
| ***C22F 1/04*** | (2006.01) |

(52) U.S. Cl.
CPC ..... *B41N 1/083* (2013.01); *C22C 21/00* (2013.01); *C22F 1/04* (2013.01)

(58) Field of Classification Search
CPC ..... B41N 1/083
See application file for complete search history.

(56) References Cited

U.S. PATENT DOCUMENTS

| | | | | |
|---|---|---|---|---|
| 2002/0029709 | A1 | 3/2002 | Sawada et al. | |
| 2017/0348744 | A1* | 12/2017 | Wright | B21B 27/005 |
| 2019/0076897 | A1 | 3/2019 | Shingu et al. | |

FOREIGN PATENT DOCUMENTS

| | | | |
|---|---|---|---|
| CN | 102049915 | A | 5/2011 |
| CN | 102308011 | A | 1/2012 |

(Continued)

OTHER PUBLICATIONS

ZX China Industrial Ltd., ▯ Lithographic Plate Composition (Website), *ZX Printer China Printer Company*, Jun. 10, 2013, 2 pages. URL: https://www.zxprinter.com/support/22.html.

*Primary Examiner* — Joshua D Zimmerman
(74) *Attorney, Agent, or Firm* — Reinhart Boerner Van Deuren P.C.

(57) ABSTRACT

The present disclosure provides an aluminium alloy strip for lithographic printing plate supports, which has a rolled-in surface topography on one strip surface. Further, a method is disclosed for manufacturing the aluminium alloy strip and a printing plate for lithographic printing, with a printing plate support made of aluminium alloy. The object of proposing an aluminium alloy strip for lithographic printing plate supports is that it provides a long service life in the printing process and is roughened with less charge support entry. This is achieved in that the surface of the aluminium alloy strip has a mean peak number measured perpendicular to the rolling direction of the aluminium alloy strip.

17 Claims, 5 Drawing Sheets

(56) References Cited

FOREIGN PATENT DOCUMENTS

| | | | |
|---|---|---|---|
| CN | 108588499 | A | 9/2018 |
| CN | 109072389 | A | 12/2018 |
| CN | 110102580 | A | 8/2019 |
| EP | 0 778 158 | A1 | 6/1997 |
| EP | 1 172 228 | A2 | 1/2002 |
| EP | 2 444 254 | A1 | 4/2012 |
| EP | 3 254 772 | A1 | 12/2017 |
| JP | S6038195 | A | 2/1985 |
| JP | 2002019311 | A | 1/2002 |
| JP | 2002 224710 | A | 8/2002 |
| JP | 2015 004095 | A | 1/2015 |
| KR | 10-2017-0113576 | A | 10/2017 |
| WO | 2006/122852 | A1 | 11/2006 |
| WO | 2007/141300 | A1 | 12/2007 |

* cited by examiner

LITHO STRIP HAVING FLAT TOPOGRAPHY AND PRINTING PLATE PRODUCED THEREFROM

CROSS-REFERENCE TO RELATED PATENT APPLICATIONS

This patent application is a continuation of International Application No. PCT/EP2021/057948, filed on Mar. 26, 2021, which claims the benefit of priority to European Patent Application No. 20165738.4, filed Mar. 26, 2020, the entire teachings and disclosures of both applications are incorporated herein by reference thereto.

FIELD

The invention relates to the use of an aluminium alloy strip for manufacturing lithographic printing plates or for manufacturing printing plates for the waterless offset printing, an aluminium alloy strip for lithographic printing plate supports, which has a rolled-in surface topography on at least one strip surface, a method for manufacturing the aluminium alloy strip and a printing plate for lithographic printing or waterless offset printing comprising a printing plate support made of aluminium alloy.

BACKGROUND

Upon surface properties of litho strips, i.e. aluminium alloy strips for lithographic printing plate supports, very high demands are placed upon them. Litho strips are usually subjected to an electrochemical roughening step, which should result in comprehensive roughening and a homogeneous appearance. The roughened structure is important for the imaging layer of the printing plate supports manufactured from the litho strips. In order to be able to produce uniformly roughened surfaces a particularly flat surface of the litho strips is therefore required. The topography of the litho strip surface is essentially an impression of the roller topography of the last cold rolling pass. Elevations and depressions in the roller surface lead to grooves or webs in the litho strip surface, which can be partially retained in the further production steps for the production of the printing plate supports. The quality of the litho strip surface and thus the printing plate support is determined by the quality of the roller surface and thus, on the one hand, by the grinding practice in the surface treatment of the rollers and, on the other hand, by the ongoing wear of the rollers.

According to the published European patent application EP 2 444 254 A2 originating from the applicant, it was previously assumed that optimally ground rollers were already used in the manufacture of aluminium alloy strips for lithographic printing plate supports, since if the roller surfaces were too smooth there was a fear of slippage between the roller and the litho strip due to low frictional force on the litho strip surface and thus disruptions of the rolling process or damage to the aluminium strips. However, rollers that are too rough result in higher or too high roughness on the aluminium alloy strip, so that the aluminium alloy strip is no longer suitable for the production of printing plate supports. The mean roughness values Ra achieved so far of approx. 0.15 μm to 0.25 μm on the surfaces of the aluminium alloy strips were therefore considered sufficient for many areas of application. EP 2 444 254 A2 therefore proposes that the strip surface be treated by means of a pickling method with a specific pickling removal and subsequently has a topography whose maximum peak height Rp and/or Sp is at most 1.4 μm, preferably at most 1.2 μm, in particular at most 1.0 μm.

According to other methods known from the prior art, for example the method from WO 2006/1228 52 A1 and the method known from WO 2007/14,1300 A1, the litho strips are pickled after rolling in order to remove interfering oxide islands on the surface of the strips and thereby improve the subsequent electrochemical roughening.

EP 0 778 158 A1 discloses printing plate supports with roughened and anodised surfaces, which have a maximum peak height Rp up to 4 μm.

The Japanese patent application JP 2015 004095 A discloses an aluminum alloy sheet for a can stock of a beverage can and the production of the can. The use of the alloy strips for lithographic printing plates is not disclosed.

The same applies to the European patent application EP 3 254 772 A1, which discloses an aluminium foil for electronic devices and a method of the production of the foil. As electronic devices for example LCD-displays, OLED-displays and electronic newspaper etc. are mentioned The Chinese patent application CN 110102580 A relates also merely to a method of manufacturing of an aluminium alloy strip made from the aluminium alloy type 1100 in the temper state H14 to manufacture high-quality cosmetic bottle caps and thus no lithographic printing plate supports or lithographic printing plates themselves.

The Japanese patent application JP 2002 224710 A concerns the production of an aluminium alloy foil. For these foils, only the application as packaging material for chemicals and food is mentioned.

The US patent application US 2019/0076897 A1 relates to the production of an aluminium foil for ultraviolet reflective materials. The use of aluminium alloy strips for lithographic printing plate supports is also not disclosed in the aforementioned US patent application.

The European patent application EP 1 172 228 A2 discloses printing plate carriers for lithographic printing plates. However, the aforementioned European patent application only discloses the surface properties of roughened printing plates made of an aluminium alloy and coated with a photosensitive coating.

In the case of current printing plate supports, in particular in the case of new "development on press" printing plate supports, the thickness of the imaging coating is continuously lowered to reduce development time and save on manufacturing costs. In addition, softer imaging coatings are also used, which should also save costs in the production of the printing plate supports, but decrease in thickness during the printing operation. The aluminium alloy strips produced so far for lithographic printing plate supports are not optimally adapted to these additional challenges. It was also shown that chemical pickling could not solve this problem. The printing plate supports manufactured from well-known aluminium alloy strips therefore tend to have a shorter service life in the printing process with the novel printing plate supports.

Finally, the aluminium alloy strip is usually electrochemically roughened to produce the printing plate supports. A reduction of the necessary charge carrier entry for uniform roughening of the surface of the printing plate support facing the imaging coating would also be desirable.

In addition to the arithmetic mean roughness Ra, the height of the largest profile peak of the roughness profile Rp (in short: peak height), the depth of the largest profile valley Rv (in short: trough depth) and the peak number RPc defined in DIN EN ISO 4287 and DIN EN 10049 as well as the contact area portion Smr (c) and the aspect ratio of the surface texture Str defined in DIN EN ISO 25178 are important for determining the surface quality of the litho strip and the electrochemically roughened printing plate support.

The surface parameters Ra, Rp, Rv, RPc, Smr (c) and Str mentioned here refer to optical areal measurements with a measuring surface of at least 4.5 mm×4.5 mm measured with a confocal microscope (lateral measuring point spacing 1.6 μm or smaller) and determined with analysis software. For this purpose, optical areal measurements of the parameters were carried out on three measuring surfaces of the aforementioned size and the arithmetic mean of the respective parameters was determined.

The profile parameters Ra, Rp, Rv and RPc are calculated per measuring surface area perpendicular to the rolling direction as arithmetic mean values from the available profile sections of the areal measurement. The measurement data is prepared by means of a shape compensation with a second order polynomial (F filter). A Gaussian filter with λc=250 μm is used as a waviness filter. There is no filtering of the fine roughness. For Rp, Rv, RPc and Smr (c), the values thus determined are given as mean peak height Rp, mean trough depth Rv, mean peak number RPc and mean contact area portion Smr (c=+0.25 μm).

In the case of the contact area portion Smr (c) of the surface, the proportion of the surface oriented in the rolling direction, in particular grooves and webs oriented in this direction, which are generated by rolling and are generally not removed by electrochemical roughening, is of particular importance. However, these can be detected by separating and back-transforming the portions in the rolling direction after a Fourier transformation of the measured surface and then the contact area portion Smr (c=+0.25 μm) of these structures is determined from the back-transformed surface portions.

The isotropy of the roughening of the printing plate support can be specified by the aspect ratio of the surface texture Str in accordance with DIN EN ISO 25178. For the calculation of the Str value, the number of measuring points of the measuring surface area is scaled to a power of 2. The scaled numerical values are calculated with a resampling operation.

While the mean number of peaks RPc measured perpendicular to the rolling direction typically indicates the number of projecting regions present as roller webs on the aluminium alloy strip, the arithmetic mean roughness value Ra and the mean peak height Rp provide information about the height of these elevations in the topography of the aluminium alloy strip or the printing plate support.

The mean contact area portion Smr (c=+0.25 μm) provides information on the surface area portion of the examined surface, which is above a certain intersection line with the material proportion curve (Abbott curve), which was selected here with c=+0.25 μm. Thus, the surface area portion of the protruding regions of the surface, for example the surface portions oriented in the rolling direction, is indicated above the cutting line c=+0.25 μm in the material proportion curve of the aluminium alloy strip or the printing plate support.

The ratio of mean peak height Rp and mean trough depth Rv indicates whether the surface topography is more dominated by troughs (values <1) or peaks (values >1). The Rp/Rv ratio is almost independent of the charge support entry during electrochemical roughening.

BRIEF SUMMARY

The object of the present invention is therefore to propose the use of an aluminium alloy strip for lithographic printing plates as well as for printing plates for the waterless offset and an aluminium alloy strip for lithographic printing plate supports, which, despite the decreasing thickness of the imaging coating, provide a long service life in the printing process and can be roughened with less charge support entry. Furthermore, the invention should provide a method for manufacturing the aluminium alloy strips with the desired properties and provide printing plate, in particular "development on press" printing plates or printing plates for waterless offset printing with a long service life.

This object is achieved with the subject matters of claims 1 to 16.

According to a first teaching of the invention, the surface of the aluminium alloy strip has a mean peak number RPc measured perpendicular to the rolling direction of the aluminium alloy strip of ≤50 $cm^{-1}$, preferably ≤45 $cm^{-1}$, or particularly preferably ≤40 $cm^{-1}$, wherein c1=+0.25 μm and c2=−0.25 μm were selected as cutting lines for the RPc measurement. It has been shown that aluminium alloy strips could be further improved in terms of their suitability for manufacturing printing plate supports by optimising the surface topography rolled in during the final cold rolling pass, since the service lives of very thin imaging coatings could be increased with the aluminium alloy strips according to the invention.

It is assumed that the reduced mean peak number RPc makes the increased service life possible, since significantly fewer raised areas are present on the strip perpendicular to the rolling direction. Thus, the aluminium strips according to the invention are particularly preferably used as printing plate supports of "development on press" printing plates and of printing plates for waterless offset printing.

In a first embodiment of the aluminium alloy strip, the surface of the aluminium alloy strip also has a mean peak height Rp of at most 1.1 μm, preferably 0.45 μm to 1.1 μm. The also reduced mean peak height Rp further ensures that roller webs, if present, are reduced in height and contribute to improving service lives.

This also applies to a further embodiment of the aluminium alloy strip, according to which the mean contact area portion Smr (c=+0.25 μm) of the surface portions of the surface of the aluminium alloy strip oriented in the rolling direction in % is at most 5%, at most 4%, or at most 3.5%, wherein only the surface portions are taken into account, which result from a Fourier transformation of the surface in the rolling direction. The reduction of the mean contact area portion Smr (c=+0.25 μm) of the surface portions of the aluminium alloy strips oriented in the rolling direction leads to reduced rolling webs in length and width on the aluminium alloy strip. Rolling webs reduced in length and width according to the findings of the present invention improve the service life of printing plates manufactured from the aluminium alloy strips according to the invention.

An area-measured surface roughness measurement is carried out optically to examine the rolling webs. After a polynomial adjustment (2nd order) of the raw data and the removal of the waviness components with the help of a Gaussian filter (limit wavelength 250 μm), the height data are available in the form of a matrix a of the dimension N×M. The matrix is transformed into the frequency space with a discrete Fast Fourier Transformation (FFT), in which the surface portions, which extend in the rolling direction and perpendicular to the rolling direction, can be separated.

$$c_{jk} = \sum_{n=1}^{N}\sum_{m=1}^{M} a_{nm} e^{-2\pi i(j-1)(n-1)/N} e^{-2\pi i(k-1)(m-1)/M}$$

Only the Fourier components $c_{jk}$ of the surface portions oriented in the rolling direction are transformed back into the local space.

$$a_{jk} = \sum_{n=1}^{N}\sum_{m=1}^{M} c_{nm} e^{2\pi i(j-1)(n-1)/N} e^{2\pi i(k-1)(m-1)/M}$$

The mean contact area portion Smr (c=+0.25 μm) of the surface portions oriented in the rolling direction is then determined by evaluating the back-transformed surface portions. For this purpose, a material proportion curve in the form of an Abbot curve is generated from the back-transformed data and the contact area portion Smr (c=+0.25 μm) is determined as an intersection of the material proportion curve with a straight line at c=+0.25 μm.

Preferably, the thickness of the aluminium alloy strip according to a further embodiment is 0.10 mm to 0.5 mm, preferably 0.10 mm to 0.4 mm. In particular, aluminium strips with thicknesses of 0.10 mm to 0.4 mm are used for lithographic printing plate supports. Special formats also use thicknesses between 0.4 mm and 0.5 mm.

According to a next embodiment of the aluminium alloy strip, the aluminium alloy strip has the following composition:

0.02 wt.-%≤Si≤0.50 wt.-%, preferably 0.02 wt.-%≤Si≤0.25 wt.-%, 0.2 wt.-%≤Fe≤1.0 wt.-%, preferably 0.2 wt.-%≤Fe≤0.6 wt.-%, Cu≤0.05 wt.-%, preferably ≤0.01 wt.-%, Mn≤0.3 wt.-%, preferably <0.1 wt.-%, particularly preferably ≤0.05 wt.-%, 0.05 wt.-% wt.-%≤Mg≤0.6 wt.-%, preferably 0.1 wt.-%≤Mg≤0.4 wt.-%, Cr≤0.01 wt.-%, Zn≤0.1 wt.-%, preferably ≤0.05 wt.-%, Ti≤ 0.05 wt.-%, residual Al and impurities individually at most 0.05 wt.-% in total at most 0.15 wt.-%.

An Si content of 0.02 wt.-% to 0.50 wt.-% also influences the appearance of electrochemically roughened printing plate supports. If the Si content is less than 0.02 wt.-%, an excessive number of depressions in the aluminium strip is produced during electrochemical roughening. If the Si content is too high, above 0.50 wt.-%, the number of depressions in the roughened aluminium strip is too low and the distribution is inhomogeneous. Preferably, an Si content of 0.02 wt.-%≤Si≤0.25 wt.-% is used.

Copper negatively impairs electrochemical roughening even at low levels. Therefore, the Cu content is 0.05 wt.-%, preferably 0.01 wt.-%.

Iron contributes to the mechanical and thermal strength of the aluminium alloy strips, so that 0.2 wt.-% to 1 wt.-% of iron is permissible. With further increased contents, the roughening behaviour deteriorates during electrochemical roughening. A preferred Fe content is between 0.2 wt.-% to 0.6 wt.-% or 0.4 wt.-% to 0.6 wt.-%.

Magnesium ensures an increase in strength, in particular in the hard-rolled state of the printing plate support. At the same time, too much magnesium can have a negative effect on further processing due to too high strengths and with regard to the properties during electrochemical roughening. The aluminium alloy therefore preferably has an Mg content of 0.05 wt.-%≤Mg≤0.6 wt.-%. In the preferred range of 0.1 wt.-%≤Mg≤0.4 wt.-% or 0.25 wt.-% to 0.4 wt.-% strips can be provided with high strengths in the hard-rolled state and process-reliable roughening behaviour.

Manganese increases the thermal strength of the aluminium alloy strip, but also the charge support entry required for electrochemical roughening of the printing plate supports manufactured from the aluminium alloy strip. Manganese is therefore limited to 0.3 wt.-%, preferably <0.1 wt.-%, particularly preferably ≤0.05 wt.-%. Cr, Zn and Ti are also limited in order to achieve good roughening behaviour. The contents are Cr≤0.01 wt.-%, Zn≤0.1 wt.-%, preferably ≤0.05 wt.-% and Ti≤0.05 wt.-%.

Finally, the aluminium alloy strip is in the work-hardened state according to a next embodiment. This results in improved handling during the production of the printing plate support. Due to the magnesium content, the aluminium alloy strips have relatively high strengths in these states, so that good processing is enabled during the electrochemical roughening and during the application of the imaging layer in the strip-shaped state. For example, the state H18 manufactured by cold rolling with intermediate annealing or H19 manufactured by cold rolling without intermediate annealing are preferably used as work-hardened states.

According to a further teaching of the invention, a method for manufacturing an aluminium alloy strip according to the invention is provided, in which a rolling ingot is cast from an aluminium alloy for lithographic printing plate supports, optionally preheated or homogenised prior to hot rolling, the rolling ingot is hot-rolled into a hot strip and the hot strip is then cold-rolled with or without intermediate annealing to final thickness, wherein a work roll is used in the last cold rolling pass, which has a mean roughness Ra of less than 0.18 μm, preferably less than 0.17 μm or preferably at most 0.15 μm. The surface topography of a litho strip is essentially determined by the surface topography of the work roll in the last cold rolling pass. It has been shown that an aluminium alloy strip can be produced with the method according to the invention, which can be further processed into printing plate supports with improved service life in printing. The long service life in printing is also achieved with "development on press" printing plates or with printing plates for waterless offset printing, which have particularly thin imaging coatings. The mean roughness Ra of the work rolls is determined in accordance with DIN EN ISO 4287, wherein the roller surfaces according to the invention have at least parallel to the longitudinal axis of the work roll a mean roughness Ra of less than 0.18 μm, preferably less than 0.17 μμm or preferably at maximum of 15 μμm.

It has also been shown that according to a preferred embodiment of the method, the work roll in the last cold rolling pass has a roller surface with a mean trough depth Rv measured parallel to the longitudinal axis of the work roll of at most 1.2 μm. This achieved particularly good results in the provision of the aluminium strip topographies according to the invention.

If a work roll is used in the last cold rolling pass which has a mean roughness Ra of at least 0.07 μm, preferably at least 0.10 μm, a slippage between the roll and the litho strip can be reliably avoided and a stable production process can be provided, contrary to the previous assumption.

According to a next embodiment of the method, the degree of unrolling in the last cold rolling pass is at least 20%, preferably at least 30% in order to achieve sufficient imprinting of the surface topography of the roller surface in the last cold rolling pass.

In order to provide a surface that is as issue-free as possible and at the same time enable the most economical production of the aluminium alloy strips, the degree of unrolling in the last cold rolling pass is a maximum of 65%, preferably a maximum of 60%.

According to a further teaching of the invention, a printing plate for the lithographic printing comprising a printing plate support made of an aluminium alloy, in particular manufactured from an aluminium alloy strip according to the invention, is provided in that at least the surface of the printing plate support facing the imaging layer has a contact area portion Smr (c=+0.25 μm) of the surface portions oriented in the rolling direction less than 5%, less than 4.5% or at maximum 4% after the electrochemical roughening of the printing plate support. It has been shown that the service life of the printing plate in printing could be significantly improved by the reduced contact area portion Smr (c=+0.25 μμm).

In particular after the electrochemical roughening, the use of the aluminium alloy strip according to the invention showed a further reduction of the mean contact area portion Smr (c=+0.25 μm) to significantly less than 5% or less than 4.5% or at a maximum of 4%, which further improves the service life of the printing plate in printing.

According to a further embodiment of the printing plate, at least the surface of the printing plate support facing the imaging layer after the electrochemical roughening of the printing plate support has a ratio of the mean peak height to the mean trough depth Rp/Rv of a maximum of 0.45, preferably a maximum of 0.4. Independent of the charge support entry during electrochemical roughening, the specified ratio of the mean peak height to the mean trough depth defines a topography of the surface of the printing plate support, wherein the mean peak height is lower in relation to the mean trough depth by more than a factor of 2.

The topography of the printing plate support is therefore dominated by troughs and formed very flat in the direction of the imaging coating, which significantly improves the service lives of thin coatings in printing, for example of coatings of "development on press" printing plates or printing plates for waterless offset printing.

After electrochemical roughening, preferably at least the side of the printing plate support facing the imaging layer has a mean peak height Rp of less than 1.2 μm, at maximum 1.1 μm or preferably at maximum 1 μm. By the reduction of the absolute value of the mean peak heights Rp, an improvement in the service life of the printing plate can also be achieved, for example, of "development on press" printing plates or printing plates for waterless offset printing. This is achieved, for example, by using an aluminium alloy strip according to the invention.

If printing plate supports are manufactured with the aluminium alloy strip according to the invention, the printing plate supports can also be roughened homogeneously or isotropically with less charge carrier entry. Aluminium alloy strips according to the invention already showed in the case of low charge carrier entry high aspect ratios of surface texture Str. Thus, according to one embodiment, at least the surface of the printing plate support facing the imaging layer after an electrochemical roughening with a charge carrier entry of at least 500 C/dm$^2$ has an aspect ratio of the surface texture Str according to DIN EN ISO 25178 of at least 50%. The aspect ratio Str of the surface texture is a measure of the uniformity of the surface texture. At a value of 100% or 1, the surface texture is isotropic, i.e. independent of direction. The printing plate supports according to the invention therefore already provide a high aspect ratio Str of the surface texture even with low charge carrier entry, so that the effort required for the electrochemical roughening can be reduced. This allows the printing plate to be produced at a lower cost.

This also applies to a further embodiment of the printing plate in which at least the coated surface facing the imaging layer reaches an aspect ratio of the surface texture Str in accordance with DIN EN ISO 25178 of at least 20% after an electrochemical roughening with a charge carrier entry of 400 C/dm$^2$.

Finally, according to a further embodiment, a printing plate for the waterless offset printing according to the invention has a printing plate support manufactured from an aluminium alloy strip according to the invention. The imaging coatings of printing plates for waterless offset printing also have particularly low thicknesses, so that the service lives of the printing plates for waterless offset printing benefit to a great extent from the surface topography of the aluminium alloy strip. However, printing plate supports for printing plates for waterless offset printing are not electrochemically roughened before they are image-coated.

BRIEF DESCRIPTION OF THE DRAWINGS

The invention is explained further by means of embodiments. Reference is made to this end to the following tables and the drawing. In the drawing

DETAILED DESCRIPTION

Figure 1:
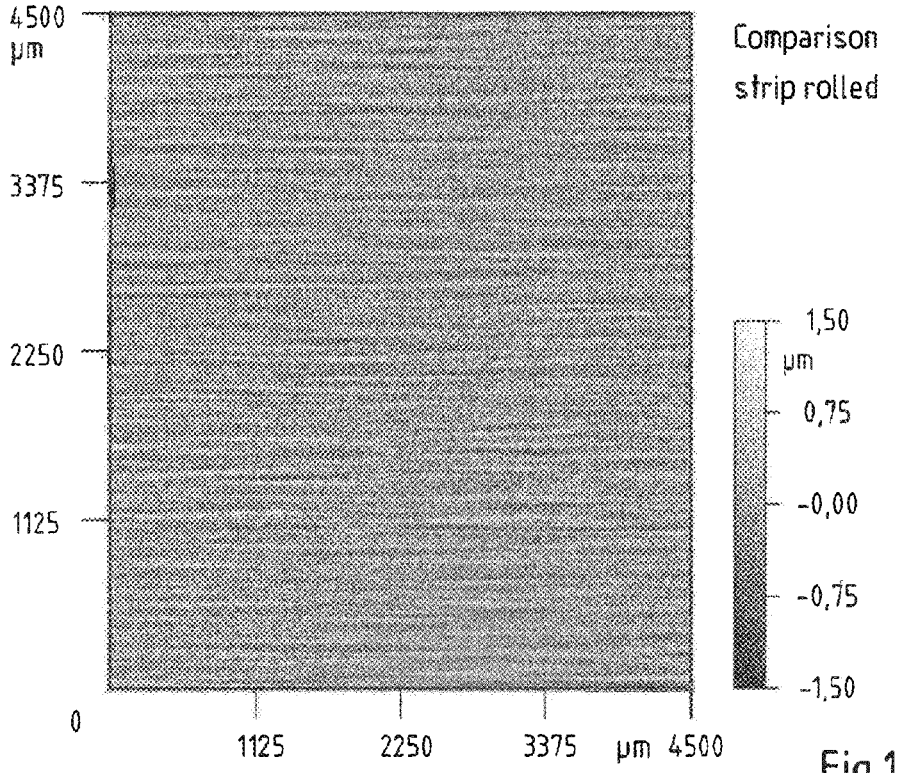
FIGS. 1-4 show measuring surfaces of optically measured comparison litho strips, which were electrochemically roughened with different charge carrier entries in a false colour representation of the height values.
Figure 2:
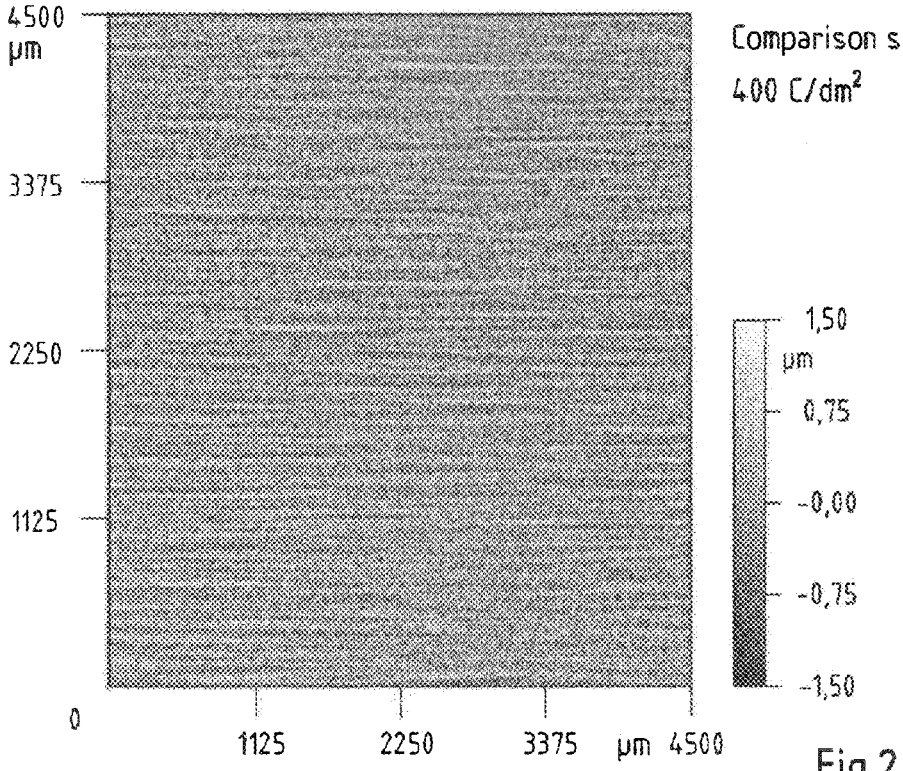
Figure 3:
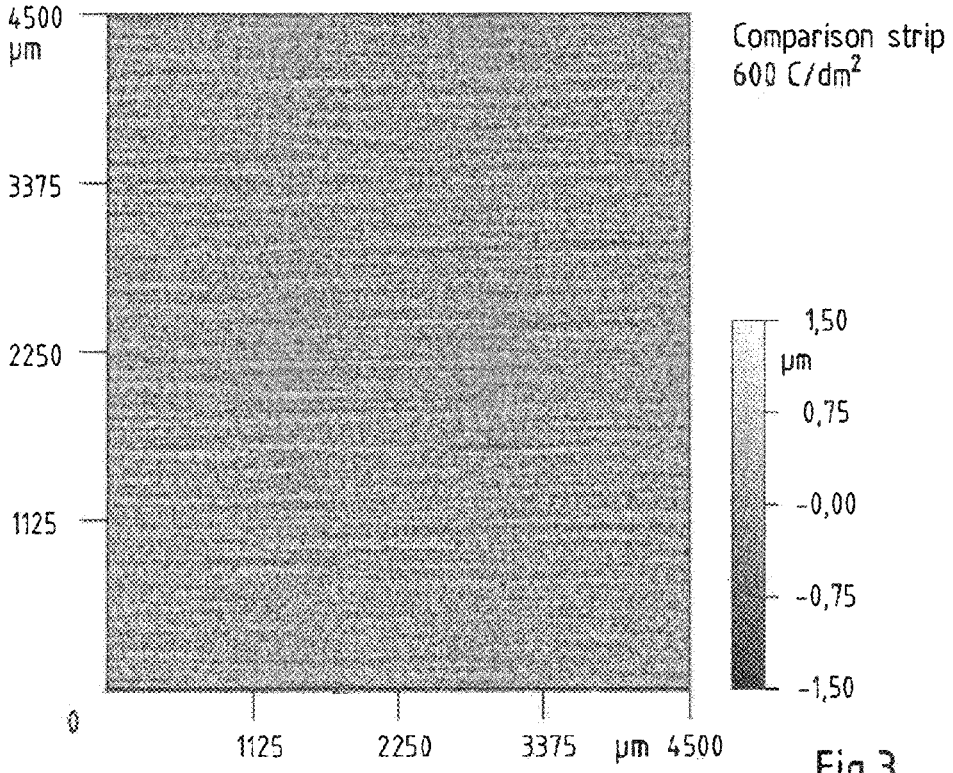
Figure 4:
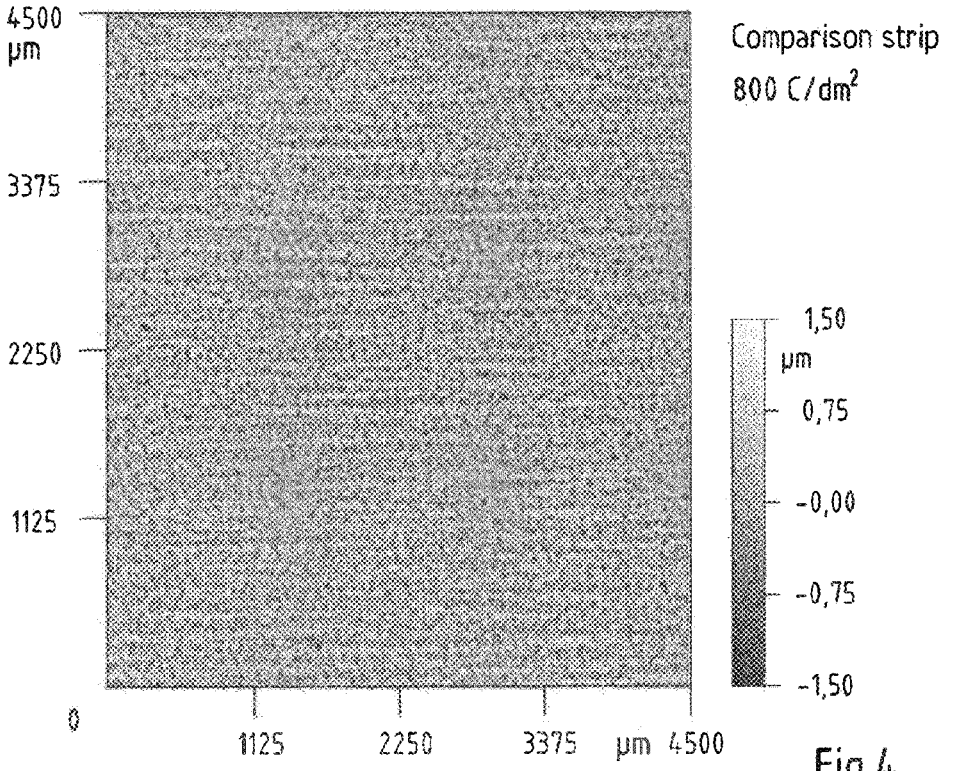
Figure 5:
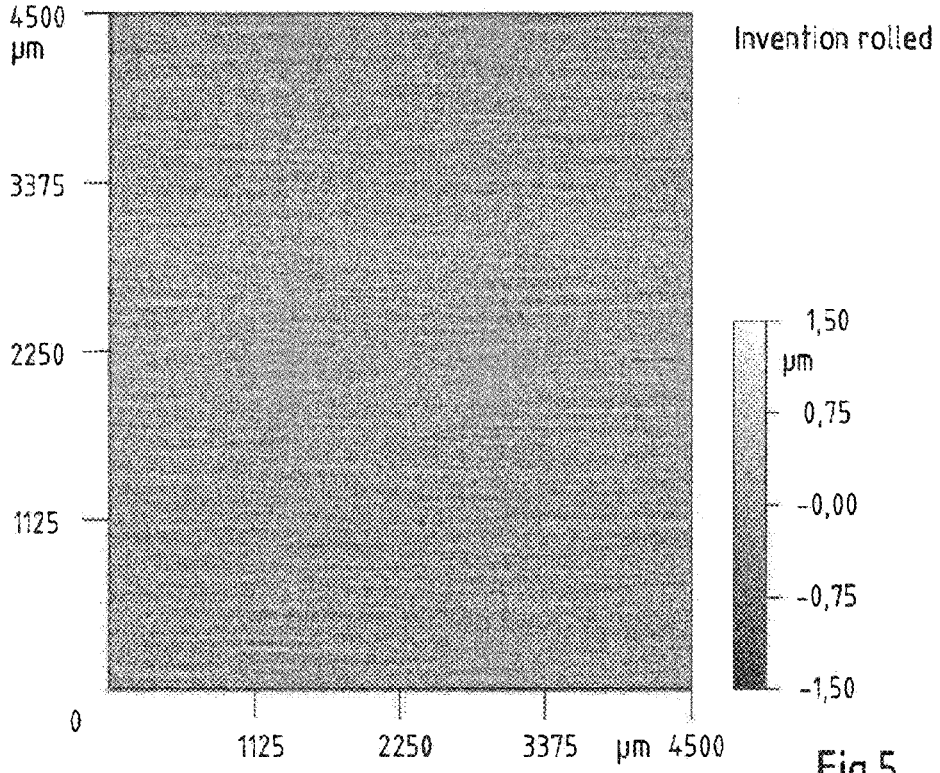
FIGS. 5-8 show measuring surfaces of optically measured litho strips according to the invention, which were electrochemically roughened with different charge carrier entries in a false colour representation of the height values.
Figure 6:
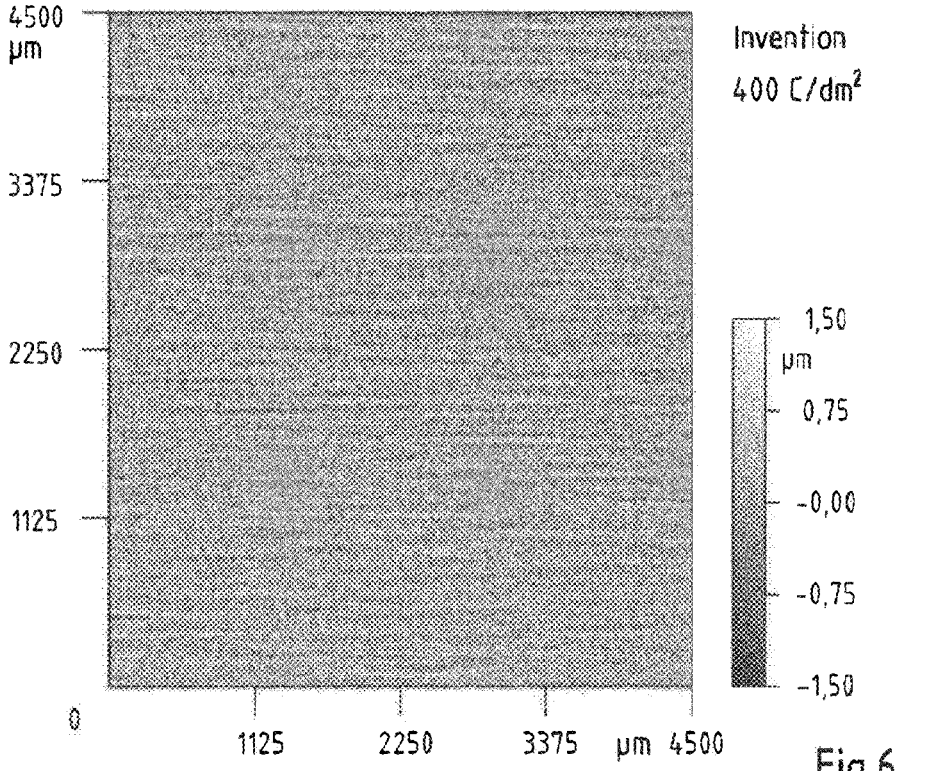
Figure 7:
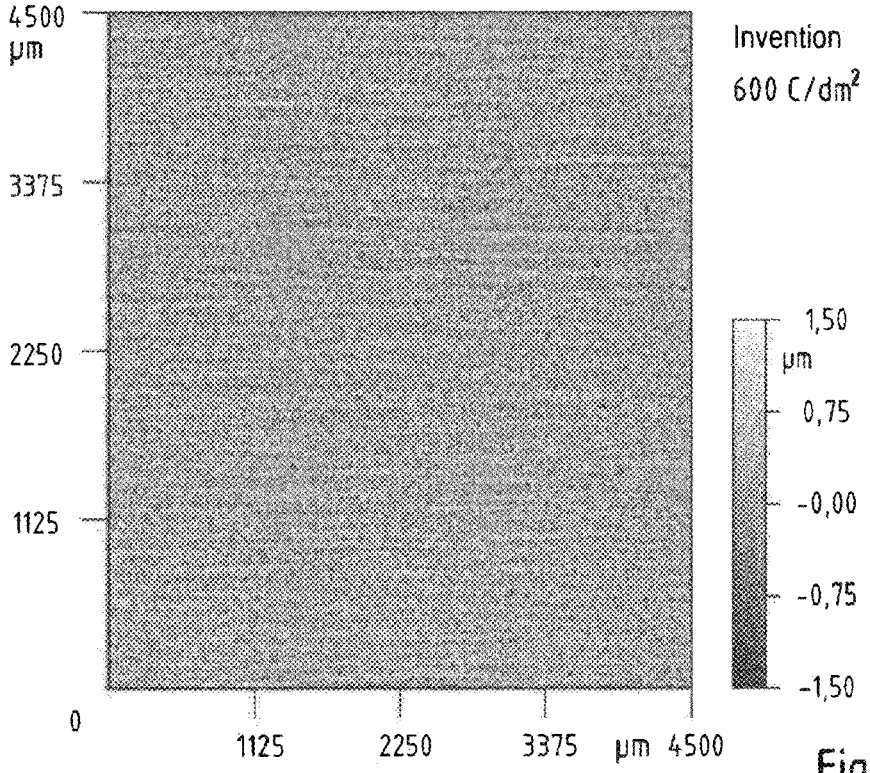
Figure 8:
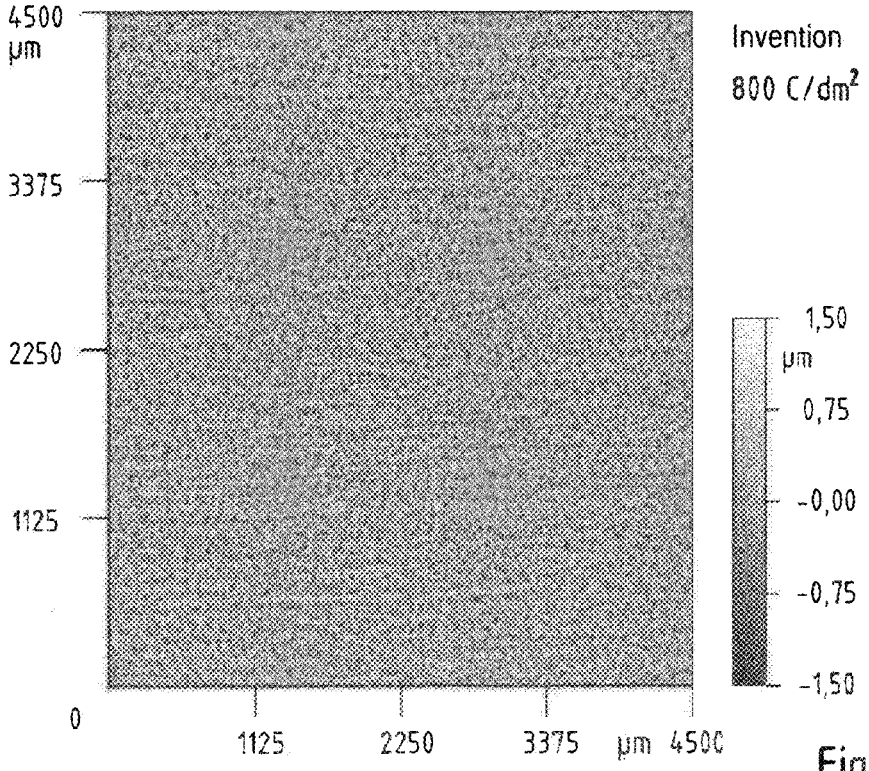

The litho strips, the measuring surfaces of which are shown in FIG. 1-8, were produced from a rolling ingot made of an aluminium alloy with the following composition:

0.02 wt.-%≤Si≤0.50 wt.-%, preferably 0.02 wt.-%≤Si≤0.25 wt.-%, 0.2 wt.-%≤Fe≤1.0 wt.-%, preferably 0.2 wt.-%≤Fe≤0.6 wt.-%, Cu ≤0.05 wt.-%, preferably ≤0.01 wt.-%, Mn≤0.3 wt.-%, preferably <0.1 wt.-%, particularly preferably ≤0.05 wt.-%, 0.05 wt.-%≤Mg≤0.6 wt.-%, preferably 0.1 wt.-%≤Mg≤0.4 wt.-%, Cr≤0.01 wt.-%, Zn≤0.1 wt.-%, preferably ≤0.05 wt.-%, Ti≤ 0.05 wt.-%, residual Al and impurities individually at most 0.05 wt.-% in total at most 0.15 wt.-%.

The manufacture by casting a rolling ingot, homogenising the rolling ingot at 450 to 610° C. for at least 1 h, hot rolling the rolling ingot to a hot strip with a thickness of approx. 2-7 mm and cold rolling of the hot strip with or without intermediate annealing to final thickness.

In the last cold rolling pass, in the litho strips according to the invention of FIGS. 5-8 a work roll is used, the surface topography of which has an arithmetic mean roughness Ra in accordance with DIN ISO 4287 of less than 0.18 μm, preferably a maximum of 0.17 μm or a maximum of 0.15 μm. The mean trough depth Rv of the surface of the work rolls of the embodiments according to the invention was max. 1.2 μμm.

The comparison litho strips in FIGS. 1-4, on the other hand, were cold-rolled with a work roll in the last cold rolling pass, which has an arithmetic mean roughness Ra of 0.22 μμm-0.25 μμm. At a maximum of 1.6 μm, the mean trough depth Rv was also higher than in the work rolls to be used according to the invention. The sheets produced in this way were electrochemically roughened in HCl as electrolytes with various charge carrier entries from 400 C/dm$^2$ to 800 C/dm$^2$.

The height values of the optically measured measuring surface areas are shown in FIGS. 1-8 in false colours, wherein depressions are assigned grey to black colour shades and elevations assigned light grey to white grey tones. With the human eye, differences can already be detected on the measuring surface areas shown in this way in the not roughened state. Thus, the litho strips according to the invention show a significantly less structured surface in the rolling direction. This effect becomes stronger with increasing roughening. Further measurements were carried out on litho strips of the embodiments a, b, c, d and m as well as the comparative examples f, g, h, which had aluminium alloy compositions according to Table 1.

All measured values Rp, RPc, Rv, Ra, Smr and Str of the embodiments and comparative examples were optically measured on three measuring surface areas of the size 4.5 mm×4.5 mm with a confocal microscope and determined with analysis software (Digital Surf MountainsMap®). The measuring surface areas were randomly arranged on the strips and the printing plate supports in a DIN A4 sized area. The corresponding points on the strips were free of surface damage. The arithmetic mean of the three measuring surface areas for each parameter was calculated, wherein within the measuring surface areas the profile parameters perpendicular to the rolling direction Rp, RPc, Rv, Ra were calculated as arithmetic mean values. The measurement data was prepared by means of a shape compensation with a second order polynomial (F filter). A Gaussian filter with λc=250 μm was used as a waviness filter. The fine roughness was not filtered.

The litho strips a, b, c, d and m were manufactured identically by the above-mentioned method starting with the casting of a rolling ingot, homogenisation of the rolling ingot, hot rolling of the rolling ingot and cold rolling of the hot strip at the end thickness with intermediate annealing (H18) and without intermediate annealing (H19).

The resulting thicknesses, material conditions and arithmetic mean roughness values Ra of the surfaces of the resulting litho strips are specified in Table 1. The different roller topographies used for the last cold rolling pass can be found in Table 7.

The litho strips according to the invention were therefore cold-rolled in the last cold rolling pass with a work roll with a roller surface, which according to Table 7 had an arithmetic mean roughness Ra of 0.11 μm to 0.17 μm, with the indicated degree of unrolling. The mean trough depth Rv was measured with less than 1.2 μμm. At 40% to 55%, the degree of rolling was in the range of at least 20% according to the invention. Furthermore, the degree of rolling was also below 60% or below 65% at a maximum of 55%, so that good surface properties were achieved with the lowest possible number of roll passes.

The arithmetic mean roughness value Ra of the roller surface of the work roll in the last cold rolling pass of the comparison strips was between 0.22 μm and 0.25 μm. At a maximum of 1.6 μm, the mean trough depth Rv was also significantly higher than in the work rolls used according to the invention.

In the manufacture of the embodiments according to the invention, contrary to the previous opinion of the experts, a stable production process has been shown without disruptions occurring during cold rolling due to slippage between the cold rolling and the litho strip to be rolled.

First differences between the comparison strips and the litho strips according to the invention were found in the arithmetic mean roughness values Ra of the litho strips a, b, c, d and m according to the invention. At 0.09 μm to 0.11 μm, these were significantly below the values of the comparison examples f, g and h with approx. 0.19 μm. These values of the arithmetic mean roughness value Ra perpendicular to the rolling direction result from the provision of a roller surface, which has an arithmetic mean roughness value Ra of less than 0.18 μm.

The aluminium strips a, b, c, d and m according to the invention also showed, as shown in Table 2, mean peak numbers RPc measured perpendicular to the rolling direction of significantly less than 50 cm$^{-1}$. The comparison strips with a mean number of peaks RPc of more than 68 cm$^{-1}$ were, on the other hand, significantly above the results of the aluminium strips according to the invention.

At a maximum of 0.74 μmμm, the mean peak height Rp in the aluminium alloy strips according to the invention was also significantly below the mean peak heights Rp of the comparison strips, which had at least 0.88 μm as the mean peak height Rp, wherein the low mean peak height Rp is attributed to the lower trough depth Rv of the roller surface.

Figure 9:
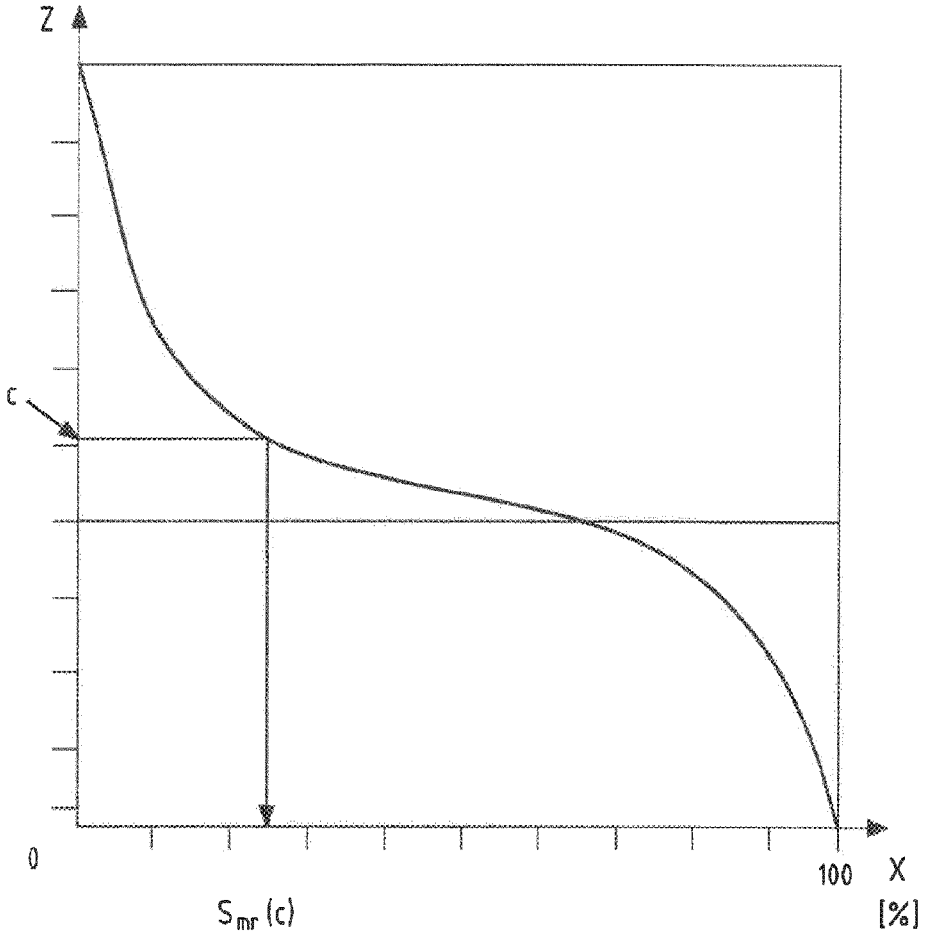
FIG. 9 shows a material proportion curve in the form of an Abbott curve for determining the contact area portion Smr (c).

The mean contact area portion Smr (c=+0.25 μμm) of the surface portions oriented in the rolling direction was significantly lower in the embodiments according to the invention. FIG. 9 shows by way of example how the contact area portion Smr (c) can be determined from a material proportion curve in the form of an Abbott curve for a value c. The value c=0 results as can be seen in FIG. 9 with a material proportion of 100%. The c-value is read on the Z-axis, which corresponds to a height value of the surface topography. To determine the contact area portion Smr (c) the intersection point of the material proportion curve is determined with the straight line Z=c and the corresponding material proportion is read on the X axis.

In order to determine the mean contact area portion Smr (c=+0.25 μm), as explained above, optical measurement results are subjected to a roughness measurement of a Fourier transformation and only the surface portions oriented in the rolling direction are back-transformed. From the back-transformed surface data, a material proportion curve, as shown in FIG. 9 and a value for the contact area portion Smr (c=+0.25 μm) is determined. From the contact area portions Smr (c=+0.25 μm) determined on three measuring surfaces of the surface portions oriented in the rolling direction the arithmetic mean was then calculated to determine the mean contact area portion Smr (c=+0.25 μm).

The mean contact area portions Smr (c=+0.25 μm) of the surface portions of the aluminium alloy strips according to the invention oriented in the rolling direction were at a maximum of 3.79% significantly below 5%. While the contact area portion Smr (c=+0.25 μm) of the surface portions of the comparison strips oriented in the rolling direction was at least 8.09% more than twice as high as the maximum measured mean contact area portion Smr (c=+0.25 μm) of the surface portions of the aluminium strips according to the invention oriented in the rolling direction.

The printing plate supports manufactured from aluminium strips according to the invention showed a significantly improved service life in printing when using "development on press" coatings compared to the comparative examples. This is attributed to the differences in the surface topography. It is assumed that the same also applies to printing plates for waterless offset printing.

The properties of the aluminium strips in electrochemical roughening were tested with HCl as electrolyte, wherein different charge support entries were used. The concentration of the electrolyte was 6 g HCl per litre and 1 g/L $Al_{3+}$ in the form of $AlCl_3$ at 25 to 30° C. with a current density of 20 A/dm$^2$ and alternating current.

FIGS. 1-8 have already shown that the charge carrier entry causes small depressions shown in black in the figures, which increase in number with increasing charge carrier entry. At the same time, electrochemical roughening also has effects on other surface parameters of the aluminium alloy strip surface, which is facing the imaging coating of the printing plate.

Printing plate supports manufactured from the electrochemically roughened aluminium strips showed significant differences in terms of the mean contact area portion Smr (c=+0.25 μm) of the surface portions oriented in the rolling direction, as can be seen in Table 4. The printing plate supports according to the invention has significantly lower mean contact area portions Smr (c=+0.25 μm) of the surface portions oriented in the rolling direction, which decreased even further, in particular with very high charge carrier entry at 700 C/dm$^2$ or 800 C/dm$^2$. Similar behaviour was also shown in the comparison strips, albeit at a much higher level. Overall, the mean contact area portion Smr (c=+0.25 μm) of the surface portions oriented in the rolling direction are not reduced below the 4% limit by the electrochemical roughening of the comparison strips. The aluminium strips according to the invention also showed a ratio Rp/Rv of a maximum of 0.45, wherein most of the values were below 0.41. As expected there was a very low dependency on the charge carrier entry during electrochemical roughening. The comparison examples were significantly above these values. A value of 0.43 at 400 C/dm$^2$ and 500 C/dm$^2$ charge carrier entry could only be measured in comparative example f.

However, the printing plate supports according to the invention manufactured from the test strips a, b, c, d and m showed a ratio Rp/Rv of 0.40 to 0.34 from 600 C/dm$^2$ and thus a significantly lower Rp/Rv ratio than in the comparison strips. The surface topographies of the printing plate supports according to the invention were thus designed to be even flatter than in the case of printing plate supports manufactured from the comparison strips. The examinations of the aspect ratio of the surface texture Str after electrochemical roughening showed significant differences. The aspect ratio Str is a measure of the isotropy of the roughened surface. The value Str reaches 100% when the surface is completely isotropic. While the printing plate supports a, b, c, d and m produced from test strips according to the invention can already provide an aspect ratio of the surface texture Str of at least 20% or at 500 C/dm$^2$ of at least 50% at 400 C/dm$^2$, the comparison strips only show an aspect ratio of the surface texture Str of at least 20% at 700 C/dm$^2$.

It follows from this that the aluminium strips according to the invention can provide isotropically roughened surfaces with less charge support entry and can thus be processed more economically into printing plates. At the same time, the printing plates according to the invention also provide a longer service life for printing plates with very thin imaging coatings.

TABLE 1

Composition of the test strips in wt.-%, residual Al, unavoidable impurities individually max. 0.05 wt.-%, in total max. 0.15 wt.-%, arithmetic mean roughness Ra defined in DIN EN 10049 perpendicular to the rolling direction, state H18 with intermediate annealing, state H19 without intermediate annealing during cold rolling.

| Test | | | Thickness | Ra | Composition in wt.-%, | | | | | | | |
|---|---|---|---|---|---|---|---|---|---|---|---|---|
| strips | | State | [mm] | [μm] | Si | Fe | Cu | Mn | Mg | Cr | Zn | Ti |
| a | Inv. | H18 | 0.37 | 0.11 | 0.08 | 0.37 | 0.001 | 0.004 | 0.20 | 0.001 | 0.012 | 0.005 |
| b | Inv. | H19 | 0.37 | 0.09 | 0.08 | 0.43 | 0.001 | 0.040 | 0.28 | 0.001 | 0.012 | 0.006 |
| c | Inv. | H19 | 0.275 | 0.10 | 0.08 | 0.43 | 0.001 | 0.040 | 0.27 | 0.001 | 0.011 | 0.005 |
| d | Inv. | H18 | 0.274 | 0.11 | 0.09 | 0.45 | 0.002 | 0.042 | 0.28 | 0.001 | 0.011 | 0.006 |
| m | Inv. | H19 | 0.37 | 0.11 | 0.08 | 0.43 | 0.001 | 0.041 | 0.28 | 0.001 | 0.013 | 0.007 |
| f | Comp. | H18 | 0.275 | 0.19 | 0.09 | 0.38 | 0.001 | 0.002 | 0.20 | 0.000 | 0.014 | 0.008 |
| g | Comp. | H19 | 0.275 | 0.19 | 0.09 | 0.44 | 0.001 | 0.042 | 0.28 | 0.001 | 0.012 | 0.008 |
| h | Comp. | H18 | 0.275 | 0.19 | 0.09 | 0.43 | 0.001 | 0.041 | 0.28 | 0.001 | 0.011 | 0.008 |

TABLE 2

Surface measurements of aluminium alloy strips after rolling, mean peak height Rp, mean peak number RPc defined in DIN EN ISO 4287 and DIN EN 10049 with calibrated optical roughness measurement system, Smr with calibrated optical Roughness measurement system defined in DIN EN ISO 25178.

| Test strips | | Rp [μm] | RPc [$cm_{-1}$] | Smr c = +0.25 μm [%] |
|---|---|---|---|---|
| a | inv. | 0.65 | 35.2 | 3.45 |
| b | inv. | 0.65 | 12.9 | 2.00 |
| c | Inv. | 0.69 | 9.4 | 1.73 |
| d | Inv. | 0.73 | 20.5 | 2.78 |
| m | Inv. | 0.74 | 34.3 | 3.78 |
| f | Comp. | 0.88 | 68.4 | 8.09 |
| g | Comp. | 1.32 | 92.3 | 11.47 |
| h | Comp. | 1.06 | 74.4 | 9.32 |

TABLE 3

Mean peak height Rp defined in DIN EN ISO 4287 on the roughened printing plate support depending on the charge carrier entry for electrochemical roughening in HCl.

| | | Roughening in HCl - charge carrier entry [C/dm$^2$] | | | | | | |
|---|---|---|---|---|---|---|---|---|
| | | Not roughened | 300 | 400 | 500 | 600 | 700 | 800 |
| Test strips | | Rp [μm] | | | | | | |
| a | Inv. | 0.65 | 0.73 | 0.77 | 0.95 | 0.95 | 1.01 | 1.03 |
| b | Inv. | 0.65 | 0.65 | 0.78 | 0.76 | 0.82 | 0.88 | 0.93 |
| c | Inv. | 0.69 | 0.71 | 0.74 | 0.86 | 0.86 | 0.90 | 0.97 |
| d | Inv. | 0.73 | — | 0.80 | 0.86 | 0.92 | 1.01 | 1.01 |
| m | Inv. | 0.74 | 0.75 | 0.79 | 0.86 | 0.89 | 0.92 | 1.06 |
| f | Comp. | 0.88 | 0.89 | 1.09 | 1.08 | 1.19 | 1.25 | 1.26 |
| g | Comp. | 1.32 | 1.36 | 1.37 | 1.41 | 1.41 | 1.49 | 1.49 |
| h | Comp. | 1.06 | 1.06 | 1.14 | 1.23 | 1.33 | 1.29 | 1.32 |

TABLE 4

Contact area portion Smr at c = +0.25 μm in % in accordance with DIN EN ISO 25178 on roughened printing plate support depending on the charge carrier entry for electrochemical roughening in HCl.

| | | Roughening in HCl - charge carrier entry [C/dm$^2$] | | | | | | |
|---|---|---|---|---|---|---|---|---|
| | | Not roughened | 300 | 400 | 500 | 600 | 700 | 800 |
| Test strips | | Smr at c = +0.25 μm [%] | | | | | | |
| a | Inv. | 3.45 | 2.52 | 2.32 | 2.87 | 2.15 | 2.02 | 1.43 |
| b | Inv. | 2.00 | 1.36 | 0.73 | 0.74 | 0.60 | 0.63 | 0.34 |
| c | Inv. | 1.73 | 1.99 | 1.68 | 1.70 | 1.18 | 0.77 | 0.66 |
| d | Inv. | 2.78 | — | 1.87 | 1.57 | 1.55 | 1.56 | 0.86 |
| m | Inv. | 3.78 | 2.70 | 2.25 | 1.92 | 1.81 | 1.10 | 1.20 |
| f | Comp. | 8.09 | 8.06 | 7.67 | 6.51 | 6.37 | 5.81 | 4.16 |
| g | Comp. | 11.47 | 10.22 | 11.14 | 9.96 | 8.52 | 8.57 | 6.07 |
| h | Comp. | 9.32 | 8.88 | 8.67 | 8.08 | 7.63 | 6.69 | 4.88 |

TABLE 5

Ratio Rp/Rv in each case defined in DIN EN ISO 4287 on the roughened printing plate support depending on the charge carrier entry for electrochemical roughening in HCl.

| Test strips | | Roughening in HCl - charge carrier entry [C/dm$^2$] | | | | | | |
|---|---|---|---|---|---|---|---|---|
| | | Not roughened | 300 | 400 | 500 | 600 | 700 | 800 |
| | | Rp/Rv | | | | | | |
| a | Inv. | 1.04 | 0.44 | 0.39 | 0.44 | 0.39 | 0.38 | 0.38 |
| b | Inv. | 1.33 | 0.35 | 0.39 | 0.34 | 0.34 | 0.34 | 0.34 |
| c | Inv. | 1.53 | 0.45 | 0.38 | 0.38 | 0.36 | 0.35 | 0.35 |
| d | Inv. | 1.38 | — | 0.41 | 0.37 | 0.40 | 0.38 | 0.37 |
| m | Inv. | 1.39 | 0.45 | 0.38 | 0.38 | 0.38 | 0.35 | 0.38 |
| f | Comp. | 1.24 | 0.49 | 0.43 | 0.43 | 0.47 | 0.46 | 0.46 |
| g | Comp. | 2.50 | 0.69 | 0.56 | 0.55 | 0.55 | 0.57 | 0.54 |
| h | Comp. | 2.14 | 0.71 | 0.58 | 0.58 | 0.56 | 0.50 | 0.48 |

TABLE 6

Aspect ratio of the surface texture Str in accordance with DIN EN ISO 25178 on the roughened printing plate support depending on the charge carrier entry for electrochemical roughening in HCl.

| Test strips | | Roughening in HCl - charge carrier entry [C/dm$^2$] | | | | |
|---|---|---|---|---|---|---|
| | | Not roughened | 300 | 400 | 500 | 700 |
| | | Str [%] | | | | |
| a | Inv. | 1.70 | 3.50 | 21.60 | 65.70 | 83.60 |
| b | Inv. | 1.60 | 5.60 | 70.10 | 82.90 | 83.10 |
| c | Inv. | 1.50 | 1.90 | 54.60 | 74.00 | 82.90 |
| d | Inv. | 1.80 | — | 32.10 | 76.20 | 82.60 |
| m | Inv. | 1.90 | 2.10 | 49.80 | 73.70 | 84.20 |
| f | Comp. | 1.20 | 1.50 | 2.90 | 58.20 | 79.30 |
| g | Comp. | 1.20 | 1.60 | 2.00 | 3.20 | 27.10 |
| h | Comp. | 1.40 | 1.40 | 1.80 | 2.10 | 67.20 |

TABLE 7

Arithmetic mean roughness Ra of the roller surface in accordance with DIN ISO 4287.

| Test strips | | Ra [μm] | Degree of unrolling of last cold rolling pass |
|---|---|---|---|
| a | Inv. | 0.15 – 0.17 | 40 – 55 |
| b | Inv. | 0.11 – 0.13 | 40 – 55 |
| c | Inv. | 0.11 – 0.13 | 40 – 55 |
| d | Inv. | 0.13 – 0.15 | 40 – 55 |
| m | Inv. | 0.15 – 0.17 | 40 – 55 |
| f | Comp. | 0.22 – 0.25 | 40 – 55 |
| g | Comp. | 0.22 – 0.25 | 40 – 55 |
| h | Comp. | 0.22 – 0.25 | 40 – 55 |

The invention claimed is:

1. A method for manufacturing a lithographic printing plate support or a printing plate for the waterless offset printing, wherein the method comprises utilizing an aluminium alloy strip which has a rolled-in surface topography on at least one strip surface, wherein the surface of the aluminium alloy strip has a mean peak number RPc measured perpendicular to the rolling direction of the aluminium alloy strip of ≤50 cm$^{-1}$, wherein a first cutting line c1=+0.25 μm and a second cutting line c2=−0.25 μm were selected as cutting lines for the RPc measurement and the mean peak number RPc is determined from an optical areal measurement of three measuring areas of at least 4.5 mm×4.5 mm with a confocal microscope having a lateral measuring point spacing of 1.6 μm or less, wherein within the measuring areas the arithmetic mean value of the profile parameter RPc perpendicular to the rolling direction is calculated from the profile sections of the areal measurement available per measuring area perpendicular to the rolling direction and the arithmetic mean is calculated from the three measuring areas for the parameter, wherein the measurement data preparation is carried out by a shape adjustment with a second order polynomial (F-filter) and a Gaussian filter with λc=250 μm as waviness filter without filtering of the fine roughness.

2. An aluminium alloy strip for lithographic printing plate supports, which has a rolled-in surface topography on at least one strip surface, wherein the aluminium alloy strip has the following composition:

0.02 wt.-%≤Si≤0.50 wt.-%,
0.2 wt.-%≤Fe≤1.0 wt.-%,
Cu≤0.05 wt. %,
Mn≤0.3 wt.-%,
0.05 wt.-%≤Mg≤0.6 wt.-%,
Cr≤0.01 wt.-%,
Zn≤0.1 wt.-%,
Ti≤0.05 wt.-%,
residual Al and impurities individually maximum 0.05 wt.-%, in total maximum 0.15 wt.-%, wherein the surface of the aluminium alloy strip has a mean peak number RPc measured perpendicular to the rolling direction of the aluminium alloy strip of ≤50 cm$^{-1}$, wherein a first cutting line c1=+0.25 μm and a second cutting line c2=−0.25 μm were selected as cutting lines for the RPc measurement and the mean peak number RPc is determined from an optical areal measurement of three measuring areas of at least 4.5 mm×4.5 mm with a confocal microscope having a lateral measuring point spacing of 1.6 μm or less, wherein within the measuring areas the arithmetic mean value of the profile parameter RPc perpendicular to the rolling direction is calculated from the profile sections of the areal measurement available per measuring area perpendicular to the rolling direction and the arithmetic mean is calculated from the three measuring areas for the parameter, wherein the measurement data preparation is carried out by a shape adjustment with a second order polynomial (F-filter) and a Gaussian filter with λc=250 μm as waviness filter without filtering of the fine roughness.

3. The aluminium alloy strip of claim 2, wherein the surface of the aluminium alloy strip has a mean peak height Rp of a maximum of 1.1 μm and the peak height Rp is determined from an optical areal measurement of three measuring areas of at least 4.5 mm×4.5 mm with a confocal microscope having a lateral measuring point spacing of 1.6 μm or less, wherein within the measuring areas the arithmetic mean value of the profile parameter Rp perpendicular to the rolling direction is calculated from the profile sections of the areal measurement available per measuring area perpendicular to the rolling direction and the arithmetic mean is calculated from the three measuring areas for the parameter, wherein the measurement data preparation is carried out by a shape adjustment with a second order polynomial (F-filter) and a Gaussian filter with λc=250 μm as waviness filter without filtering of the fine roughness.

4. The aluminium alloy strip of claim 2, wherein the mean contact area portion Smr (c=+0.25 μm) of the surface portions of the surface of the aluminium alloy strip oriented in the rolling direction in % is maximum 5%, wherein only the surface portions are taken into account which follow a Fourier transformation of the surface in the rolling direction and the average contact area portion Smr (c=+0.25 μm) is determined from an optical areal measurement of three measuring areas of at least 4.5 mm×4.5 mm with a confocal microscope having a lateral measuring point spacing of 1.6 μm or less, wherein the arithmetic mean value is calculated from the three measuring areas for the parameter, wherein the measurement data preparation is carried out by a shape adjustment with a second order polynomial (F-filter) and a Gaussian filter with λc=250 μm as waviness filter without filtering of the fine roughness.

5. The aluminium alloy strip of claim 2, wherein the thickness of the aluminium alloy strip is 0.10 mm to 0.5 mm.

6. The aluminium alloy strip of claim 2, wherein the aluminium alloy strip has a work hardened state.

7. A method for manufacturing the aluminium alloy strip for lithographic printing plate supports of claim 2, in which a rolling ingot is cast from an aluminium alloy for lithographic printing plate supports, the rolling ingot is optionally preheated or homogenised before hot rolling, the rolling ingot is hot-rolled into a hot strip and the hot strip is then cold-rolled to the final thickness with or without intermediate annealing, wherein a work roll is used in the last cold rolling pass, which has an average roughness Ra according to DIN ISO 4287 of less than 0.18 μm.

8. The method of claim 7, wherein a work roll is used in the last cold rolling pass which has a mean roughness Ra according to DIN ISO 4287 of at least 0.07 μm.

9. The method of claim 7, wherein the degree of unrolling in the last cold rolling pass is at least 20%.

10. The method of claim 7, wherein the degree of unrolling in the last cold rolling pass is a maximum of 65%.

11. A printing plate for lithographic printing having a printing plate support made from an aluminium alloy, wherein at least the surface of the printing plate support facing the imaging layer after the electrochemical roughening of the printing plate support has an average contact area portion Smr (c=+0.25 μm) of the surface portions oriented in the rolling direction of less than 5%, wherein only the surface portions resulting after a Fourier transformation of the surface in the rolling direction are taken into account and the average contact area portion Smr (c=+0.25 μm) is determined from an optical areal measurement of three measuring areas of at least 4.5 mm×4.5 mm with a confocal microscope having a lateral measuring point spacing of 1.6 μm or less, wherein the arithmetic mean value is calculated from the three measuring areas for the parameter, wherein the measurement data preparation is carried out by a shape adjustment with a second order polynomial (F-filter) and a Gaussian filter with λc=250 μm as waviness filter without filtering of the fine roughness.

12. The printing plate of claim 11, wherein at least the surface of the printing plate support facing the imaging layer after the electrochemical roughening of the printing plate support is a ratio of the mean peak height to the mean trough depth Rp/Rv of a maximum of 0.45 and the mean peak height Rp and the mean trough depth Rv are determined from an optical areal measurement of three measuring areas of at least 4.5 mm×4.5 mm with a confocal microscope having a lateral measuring point spacing of 1.6 μm or less, wherein within the measuring areas the arithmetic mean value of the profile parameters Rp and Rv perpendicular to the rolling direction is calculated from the profile sections of the areal measurement available per measuring area perpendicular to the rolling direction and wherein the arithmetic mean value is calculated from the three measuring areas for the parameter, wherein the measurement data preparation is carried out by a shape adjustment with a second order polynomial (F-filter) and a Gaussian filter with λc=250 μm as waviness filter without filtering of the fine roughness.

13. The printing plate of claim 11, wherein after the electrochemical roughening of the printing plate support, at least the surface facing the imaging layer has a mean peak height Rp of less than 1.2 μm and the peak height Rp is determined from an optical areal measurement of three measuring areas of at least 4.5 mm×4.5 mm with a confocal microscope having a lateral measuring point spacing of 1.6 μm or less, wherein within the measuring areas the arithmetic mean value of the profile parameter Rp perpendicular to the rolling direction is calculated from the profile sections of the areal measurement available per measuring area perpendicular to the rolling direction and the arithmetic mean is calculated from the three measuring areas for the parameter, wherein the measurement data preparation is carried out by a shape adjustment with a second order polynomial (F-filter) and a Gaussian filter with λc=250 μm as waviness filter without filtering of the fine roughness.

14. The printing plate of claim 11, wherein at least the surface of the printing plate support facing the imaging layer achieves an aspect ratio of the surface texture Str in accordance with DIN EN ISO 25178 of at least 50% after electrochemical roughening with a charge carrier entry of at least 500 C/dm$^2$ and the aspect ratio of the surface texture Str is determined from an optical areal measurement of three measuring areas of at least 4.5 mm×4.5 mm with a confocal microscope having a lateral measuring point spacing of 1.6 μm or less, wherein the arithmetic mean value is calculated from the three measuring areas for the parameter, wherein the measurement data preparation is carried out by a shape adjustment with a second order polynomial (F-filter) and a Gaussian filter with λc=250 μm as waviness filter without filtering of the fine roughness.

15. The printing plate of claim 14, wherein at least the surface of the printing plate support facing the imaging layer achieves an aspect ratio of the surface texture Str according to DIN EN ISO 25178 of at least 20% after electrochemical roughening with a charge carrier entry of at least 400 C/dm$^2$ and the aspect ratio of the surface texture Str is determined from an optical areal measurement of three measuring areas of at least 4.5 mm×4.5 mm with a confocal microscope having a lateral measuring point spacing of 1.6 μm or less, wherein the arithmetic mean value is calculated from the three measuring areas for the parameter, wherein the measurement data preparation is carried out by a shape adjustment with a second order polynomial (F-filter) and a Gaussian filter with λc=250 μm as waviness filter without filtering of the fine roughness.

16. A printing plate for waterless offset printing comprising a printing plate support manufactured from the aluminium alloy strip of claim 2.

17. The printing plate according to claim 11, wherein the printing plate support is manufactured from an aluminium alloy strip which has a rolled-in surface topography on at least one strip surface, wherein the aluminium alloy strip has the following composition:

0.02 wt.-%≤Si≤0.50 wt.-%,
0.2 wt.-%≤Fe≤1.0 wt.-%,
Cu≤0.05 wt.-%,
Mn≤0.3 wt.-%,
0.05 wt.-%≤Mg≤0.6 wt.-%,
Cr≤0.01 wt.-%,
Zn≤0.1 wt.-%,
Ti≤0.05 wt.-%,
residual Al and impurities individually maximum 0.05 wt.-%, in total maximum 0.15 wt.-%, wherein the surface of the aluminium alloy strip has a mean peak number RPc measured perpendicular to the rolling direction of the aluminium alloy strip of ≤50 $cm^{-1}$, wherein a first cutting line c1=+0.25 μm and a second cutting line c2=−0.25 μm were selected as cutting lines for the RPc measurement and the mean peak number RPc is determined from an optical areal measurement of three measuring areas of at least 4.5 mm×4.5 mm with a confocal microscope having a lateral measuring point spacing of 1.6 μm or less, wherein within the measuring areas the arithmetic mean value of the profile parameter RPc perpendicular to the rolling direction is calculated from the profile sections of the areal measurement available per measuring area perpendicular to the rolling direction and the arithmetic mean is calculated from the three measuring areas for the parameter, wherein the measurement data preparation is carried out by a shape adjustment with a second order polynomial (F-filter) and a Gaussian filter with λc=250 μm as waviness filter without filtering of the fine roughness.

* * * * *